US010000902B1

(12) United States Patent
Huml

(10) Patent No.: US 10,000,902 B1
(45) Date of Patent: Jun. 19, 2018

(54) REMOVABLE DOCK BRACKET SUPPORT

(71) Applicant: Jan Martin Huml, Medford, WI (US)

(72) Inventor: Jan Martin Huml, Medford, WI (US)

( * ) Notice: Subject to any disclaimer, the term of this patent is extended or adjusted under 35 U.S.C. 154(b) by 0 days. days.

(21) Appl. No.: 15/419,128

(22) Filed: Jan. 30, 2017

Related U.S. Application Data

(60) Provisional application No. 62/287,938, filed on Jan. 28, 2016.

(51) Int. Cl.
*E02B 3/06* (2006.01)
*F16M 13/02* (2006.01)

(52) U.S. Cl.
CPC ..... *E02B 3/068* (2013.01); *F16M 13/022* (2013.01)

(58) Field of Classification Search
CPC combination set(s) only.
See application file for complete search history.

(56) References Cited

U.S. PATENT DOCUMENTS 3,421,327 A * 1/1969 Donaldson ..... E02B 3/068 16/231
3,614,871 A * 10/1971 Nordell ..... E02B 3/068 182/144
4,028,899 A * 6/1977 Carmichael, III ..... E02B 3/064 248/55
4,981,397 A * 1/1991 Wiltse ..... E02B 3/068 182/179.1
5,156,493 A * 10/1992 Johnson ..... E02B 3/068 403/385
6,431,794 B1 * 8/2002 Zweber ..... E02B 3/068 248/230.3
6,536,992 B1 * 3/2003 Floe ..... E02B 3/068 114/258
2007/0248420 A1 * 10/2007 Jacobs ..... E02B 3/068 405/218
2008/0168938 A1 * 7/2008 Impey ..... E02B 3/068 114/264
2015/0003918 A1 * 1/2015 Peterson ..... E02B 3/068 405/218

* cited by examiner

*Primary Examiner* — Kyle Armstrong
(74) *Attorney, Agent, or Firm* — James Creighton Wray

(57) ABSTRACT

Dock mounting brackets have dock connections and fixed post mounting connections. A removable section of each bracket allows the removable mounting pipe bracket to be removed from the main dock bracket, which greatly reduces the weight of the dock or pier when installing or removing it from a lake or river. The removable mounting pipe bracket helps when reinstalling the dock the following year because the removable mounting pipe bracket is already adjusted to the correct height, saving installation time in the water. In cold climates, docks or piers are removed each year due to ice conditions.

9 Claims, 3 Drawing Sheets

REMOVABLE DOCK BRACKET SUPPORT

This application claims the benefit of U.S. Provisional Application No. 62/287,938 filed Jan. 28, 2016, which is hereby incorporated by reference in its entirety as if fully set forth herein.

SUMMARY OF THE INVENTION

The new product is created for the dock and pier industry. A key feature of the product is a removable section of the bracket, which allows the removable mounting pipe bracket to be removed from the main dock bracket. The separation of the removable mounting pipe bracket from the main dock bracket greatly reduces the weight of the dock or pier when installing or removing the dock or pier from a lake or river. The removable mounting pipe bracket helps when reinstalling the dock the following year, because the removable mounting pipe bracket is already adjusted to the correct height, saving installation time in the water. In cold climates docks or piers are removed each year due to the ice conditions.

The invention provides time saving and weight reduction when removing and installing a dock or pier.

These and further and other objects and features of the invention are apparent in the disclosure, which includes the above and ongoing written specification, with the claims and the drawings that show one embodiment of the invention.

DETAILED DESCRIPTION

Figure 1:
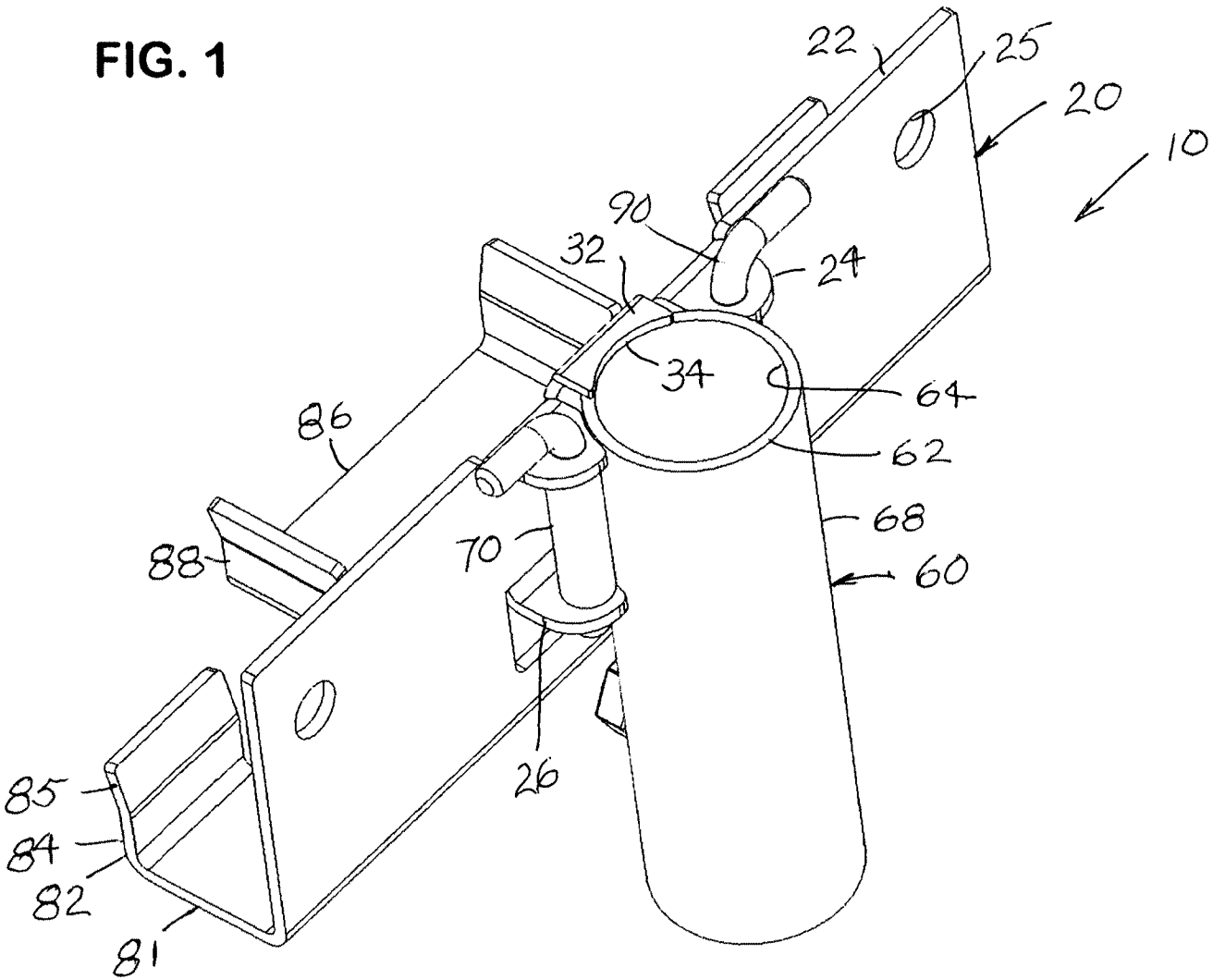
FIG. 1 is a perspective view of a removable dock bracket support.

FIG. 1 is a perspective view of a removable dock bracket support 10, and when the dock is intended to remain at a predetermined position the support attachments 70 may be permanently affixed to dock support pipes or posts that are anchored in the ground.

Figure 2:
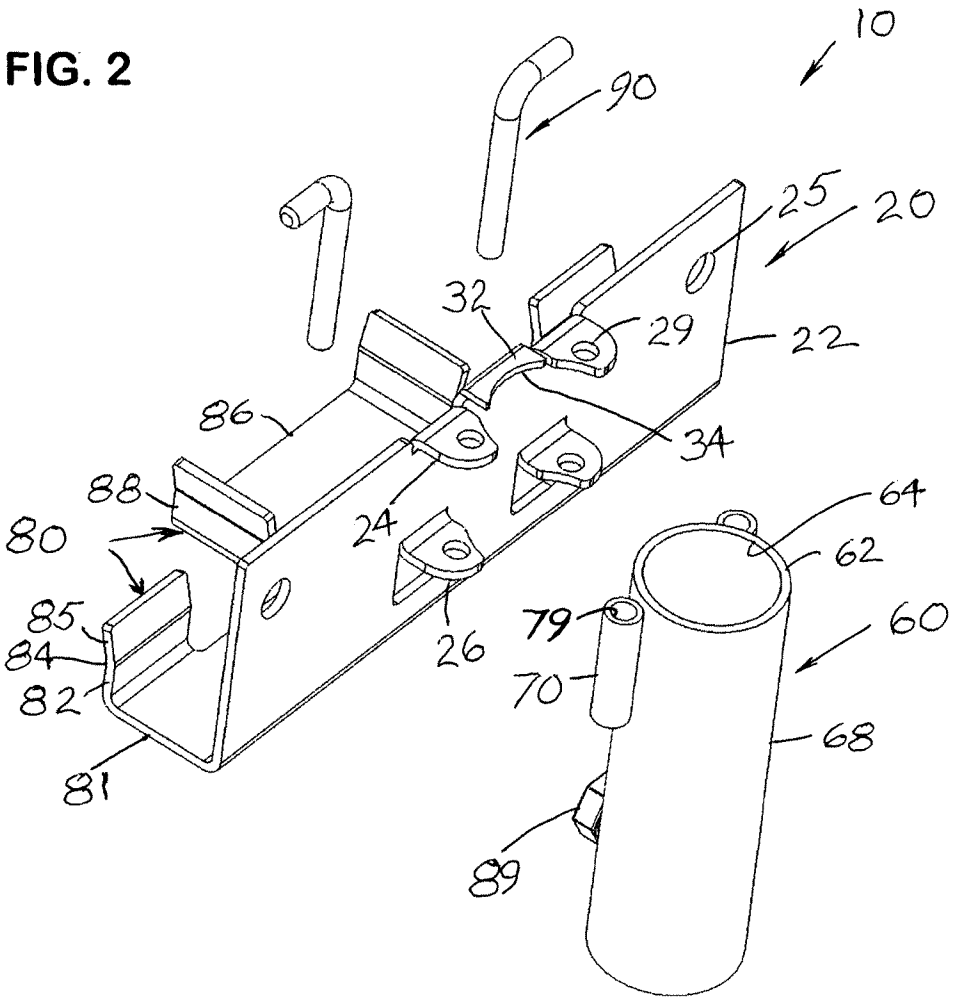
FIG. 2 is an exploded perspective view of the removable dock bracket support of FIG. 1, showing a main dock bracket support, a removable mounting collar, removable collar support attachments and removable support collar support attachment pins.

FIG. 2 is an exploded perspective view of the removable dock bracket support 10 shown in FIG. 1. FIGS. 1 and 2 show a main dock bracket support 20 which is fixed to a dock, and a removable mounting collar 60 that is secured to parallel mounting posts or that slides along a mounting post or pipe as water level rises and falls. The removable mounting collar 60 is also called a removable mounting pipe bracket. Support attachments 70 are welded on the removable mounting collar 60. Attachment pins 90 connect the support attachments 70 and the attached removable mounting collar 20 to the main dock support bracket 20.

Figure 3:
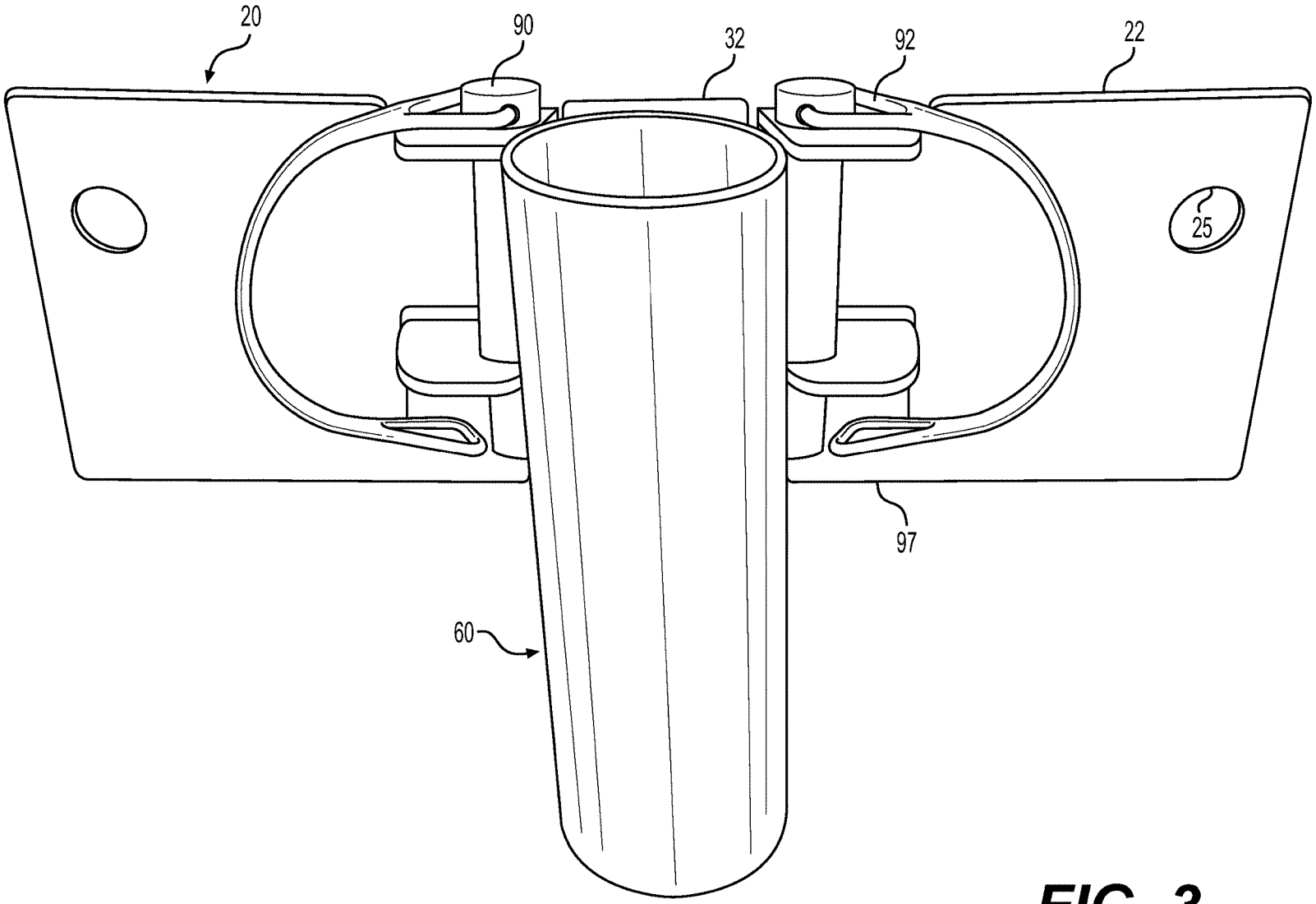
FIG. 3 is a photograph of an actual removable dock bracket support showing removable pins and keepers.

FIG. 3 is a photograph of an actual removable dock bracket support 10 showing removable pins 90 and keepers 92 with loops 97 for attaching to bottoms of pins.

The dock bracket 10 shown in FIGS. 1-3 has a main dock bracket 20, a detachable and removable mounting collar 60. The mounting collar 60 has fixed attachments 70 on the mounting collar 60 and connecting pins 80 for connecting the mounting collars to the main dock support bracket 20.

The main dock support bracket 20 has a face plate 22 for attaching to an outer frame member of a dock. The face plate 22 has vertically and horizontally spaced outward extending lugs 24 and 26 to receive and hold the attachments 70 between the spaced lugs. The lugs have arcuate inward facing surfaces 28 to engage the cylindrical outer side 68 of the collar 60. The lugs 24 and 26 have openings 29 to receive pins 90. The attachments 70 are cylinders welded on opposite sides of mounting collar 60 and have central openings 79 to receive connecting pins 90.

The face plate 22 has an outward extending upper lug 32 with an arcuate outer edge portion 34 to rest on top 62 of the mounting collar 60. The arcuate outer edge 34 of upper lug 32 has a diameter similar to the inner diameter of the central opening 64 in the mounting collar 60.

Holes 25 in the face plate 22 receive bolts to fasten the face plate to dock side frame members.

The main dock support bracket 20 has inward extending lower shelf 81. The lower shelf 81 has lower extensions 82 that terminate inwardly in upward arms 84, of which top portions 85 are bent outwardly for receiving and holding lateral dock frame members. A medial inward extension 86 extends from an inner edge of the lower shelf 81 of the dock support bracket 20. The medial inward extension 86 has upward extending sides 88 with outwardly bent top portions for receiving and holding an end of a transverse dock frame member extending under the dock of the dock.

The main dock support bracket 20 may be made of a single unitary metal piece cut, lanced and bent to form lugs 24, 26 and 32, lower shelf 81, the two lower extensions 82 and medial extension 86.

The removable mounting collars 60 slide along the ground-engaging pipes or dock legs, which may be driven into the ground or may be vertical members of a dock holding frame. The mounting collars 60 may be secured at predetermined height by tightening bolt 89 on the post on which the mounting collar is installed.

The dock section on which at least four bracket supports 10 are fastened may be floated into place between and adjacent fixed vertical pipes. When supported by floats, the dock sections may be floated into place. The mounting collars 60 are slid down over posts to the sides of the main dock brackets 20. The lugs 24 and 26 and the lug 34 extending from the main dock bracket 20 are placed against the mounting collars 60, aligning the holes 29 and 79. Pins 90 are slid through the holes.

When the dock is supported on the posts above the water, the dock sections may be floated into place. The mounting collars 60 are slid down over posts to predetermined positions on the posts. The lugs 24 and 26 and the lug 34 are placed against the posts and the dock is raised until the lugs 24 and 26 engage the cylindrical attachment 70 on the mounting collars 60, aligning the holes 29 and 79. Pins 90 are slid through the holes and the dock section is ready for use. The dock section is then raised and bolts 89 are tightened, holding the dock in place on the posts. Alternatively, the mounting collars 60 are lowered to predetermined positions to connect to the main dock brackets at that position.

When it is time to remove a dock or pier from the water, floats are positioned under the dock section bolts 89 previously tightened on ground-engaging pipes or posts, are loosened and then retightened. The pins 90 are removed from the lugs 24 and 26 and from the attachment cylinders 70. The dock and tops of the ground-engaging pipes or posts are pushed slightly apart so that the attachment pipes in the collars 60 clear the lugs 24, 26 on the main dock support bracket. The collars 60 are slid upward off the ground-engaging pipes and the pins 90 are reinserted in the attachment cylinders.

Alternatively, the bolts 89 remain tightened on the ground-engaging pipes keeping the collars 60 in place after the dock has been removed.

When the dock is ready to be placed in the water, the sections are floated and are aligned with the main dock brackets 20 near the posts. The collars 60 are placed on the ground-engaging pipes or posts. Bolts 89 are tightened to hold the collars 29 aligned with the brackets 20. The tops of the posts or ground-engaging pipes and main brackets 20 are pushed slightly apart and separated and pulled together while positioning the collar attachment cylinders 70 between lugs 24 and 26. Pins 90 are inserted, and the loops 97 on the keepers are attached to the extended bottoms of the pins.

If the dock is a floating dock, the bolts 89 are loosened or removed to allow the mounting collars 60 to move up and down with the dock.

While the invention has been described with reference to specific embodiments, modifications and variations of the invention may be constructed without departing from the scope of the invention, which is defined in the following claims.

I claim:

1. An apparatus comprising: a dock support bracket system having first main dock bracket sections and second removable mounting bracket sections for connecting to the first main dock bracket sections, the removable mounting bracket sections configured for slidably repositioning along fixed posts, the removable mounting bracket sections being connectable to and disconnectable from the main dock bracket sections, outward extending lugs connected to the main dock bracket sections, at least one pin receiver on each of the removable mounting bracket sections, and removable pins for selectively connecting the outward extending lugs on the main dock support sections to and disconnecting the outward extending lugs on the main dock support sections from the pin receivers on the removable mounting brackets; wherein the main dock support bracket sections have inward extending support shelves configured for holding dock section support frames, and the support shelves further extend inward and have upward extensions parallel to the vertical sides of the dock support bracket for holding lateral frame members, and wherein the shelves have at least one horizontal extension with upward extending flanges from the extension for holding a transverse dock frame member.

2. The apparatus of claim 1, wherein the dock support brackets have vertical sides for attaching to longitudinal side frame members of dock sections.

3. The apparatus of claim 2, wherein the outward extending lugs extend parallel outward from the vertical sides of the dock support brackets.

4. The apparatus of claim 3, wherein the outward extending lugs further comprise upper and lower lugs having aligned holes for receiving the at least one pin.

5. The apparatus of claim 4, wherein the at least one pin receiver comprises paired pin receivers on opposite sides of the mounting bracket sections, wherein the outward extending lugs further comprise spaced pairs of upper and lower lugs having inward facing surfaces configured for aligning with the removable mounting bracket sections, and wherein the upper and lower lugs have holes aligned with openings in the pin receivers for receiving the pairs of pins.

6. A system comprising: a dock support bracket system having attachable, detachable and removable sections, further comprising first main dock bracket sections and second removable mounting pipe bracket sections, the second removable mounting pipe bracket sections having vertical pin-receiving cylinders mounted on opposite sides of the second removable mounting pipe brackets, the first main dock bracket sections having sides for connecting to lateral frame members, inward facing shelves and extensions with upward facing flanges for holding the lateral frame members and transverse frame member, the first main dock member further comprising outward extending pairs of upper and lower flanges having aligned pin-receiving holes and having inward facing surfaces for aligning with the second removable mounting pipe bracket sections and the pin-receiving cylinders, and retractable pins extending through the aligned holes in the pairs of the upper and lower flanges for connecting the pairs of the upper and lower flanges with the vertical pin-receiving cylinders and holding the first main dock bracket sections and the second removable mounting pipe bracket sections connected; wherein the main dock support bracket sections have inward extending support shelves configured for holding dock section support frames, and the support shelves further extend inward and have upward extensions parallel to the vertical sides of the dock support bracket for holding lateral frame members, and wherein the shelves have at least one horizontal extension with upward extending flanges from the extension for holding a transverse dock frame member.

7. A method comprising:

mounting docks on fixed posts by providing docks with main dock brackets, providing removable mounting pipe brackets configured for mounting on fixed posts, providing vertical pin receivers fixed on the removable mounting pipe brackets, providing outward extending inward facing spaced pairs of upper and lower flanges on the main dock brackets, providing aligned pin-receiving openings in the pairs of upper and lower flanges, providing pins for extending through the pairs of upper and lower flanges and the vertical pin receivers, connecting a dock frame to the main dock brackets, connecting the removable mounting pipe brackets to fixed posts, aligning the pairs of upper and lower flanges with the removable mounting pipe brackets and the vertical pin receivers, and inserting the pins in the pairs of upper and lower flanges and the vertical pin-receivers.

8. A method comprising: mounting docks on fixed posts by providing docks with main dock brackets, providing removable mounting pipe brackets configured for mounting on fixed posts, providing vertical pin receivers fixed on the removable mounting pipe brackets, providing outward extending inward facing spaced pairs of upper and lower flanges on the main dock brackets, providing aligned pin-receiving openings in the pairs of upper and lower flanges, providing pins for extending through the pairs of upper and lower flanges and the vertical pin receivers, connecting a dock frame to the main dock brackets, connecting the removable mounting pipe brackets to fixed posts, aligning the pairs of upper and lower flanges with the removable mounting pipe brackets and the vertical pin receivers, and inserting the pins in the pairs of upper and lower flanges and the vertical pin receivers; wherein the main dock support bracket sections have inward extending support shelves configured for holding dock section support frames, and the support shelves further extend inward and have upward extensions parallel to the vertical sides of the dock support bracket for holding lateral frame members, and wherein the shelves have at least one horizontal extension with upward extending flanges from the extension for holding a transverse dock frame member.

9. The method of claim 7, further comprising removing the pins from the pairs of upper and lower flanges and the vertical pin receivers, separating the main dock bracket from the mounting pipe bracket and moving the dock to storage.

* * * * *